US007848677B2

(12) United States Patent
Kaiho

(10) Patent No.: US 7,848,677 B2
(45) **Date of Patent: *Dec. 7, 2010**

(54) IMAGE FORMING APPARATUS CAPABLE OF PREVENTING SCATTERING OF TONER

(75) Inventor: Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/350,726

(22) Filed: Jan. 8, 2009

(65) Prior Publication Data

US 2009/0123199 A1 May 14, 2009

Related U.S. Application Data

(63) Continuation of application No. 11/676,562, filed on Feb. 20, 2007, now Pat. No. 7,505,712.

(30) Foreign Application Priority Data

Feb. 20, 2006 (JP) ..... 2006-042771

(51) Int. Cl.
*G03G 21/16* (2006.01)
*G03G 15/14* (2006.01)

(52) U.S. Cl. ..... 399/121; 399/315

(58) Field of Classification Search ..... 399/121, 399/297, 299, 302, 308, 311, 315; 361/212, 361/214, 220, 221, 225, 222, 230
See application file for complete search history.

(56) References Cited

U.S. PATENT DOCUMENTS 6,243,555 B1 6/2001 Herrick et al.

FOREIGN PATENT DOCUMENTS

| | | |
|---|---|---|
| JP | 11-237794 | 8/1999 |
| JP | 2002-072615 | 3/2002 |
| JP | 2005-308784 | 11/2005 |

*Primary Examiner*—David M Gray
*Assistant Examiner*—Andrew V Do
(74) *Attorney, Agent, or Firm*—Turocy & Watson, LLP

(57) ABSTRACT

The image forming apparatus according to the present invention has: a transfer unit including an intermediate transfer medium that circularly moves; plural image forming sections provided in parallel with each other from an upstream side to a downstream side along a circulation direction of the intermediate transfer medium, the plural image forming sections each having a photosensitive drum; plural transfer rollers provided in the transfer unit so as to face the photosensitive drums of the plural image forming sections, respectively; and a charge removal means including plural charge removal members respectively provided adjacent to the transfer rollers, to remove electric charges charged on the intermediate transfer medium, with a clearance maintained between the intermediate transfer medium and the plural charge removal members, the clearance being narrowed gradually from the upstream side toward the downstream side along the circulation direction.

10 Claims, 7 Drawing Sheets

IMAGE FORMING APPARATUS CAPABLE OF PREVENTING SCATTERING OF TONER

CROSS REFERENCE TO RELATED APPLICATION

This application claims the benefit of priority from and is a Continuation of application Ser. No. 11/676,562 filed on Feb. 20, 2007, which is based upon and claims the benefit of priority from the prior Japanese Patent Application No. 2006-42771, filed on Feb. 20, 2006, the entire contents of both of which are incorporated herein by reference.

BACKGROUND OF THE INVENTION

1. Field of the Invention The present invention relates to an image forming apparatus such as a printer or a MFP (Multi-Function Peripheral) which is also called a digital composite apparatus.

2. Description of the Related Art

A tandem type image forming apparatus has been known as an image forming apparatus such as a copier or printer. In a tandem type image forming apparatus, plural photosensitive drums are arranged in parallel. Toner images respectively formed on the photosensitive drums are transferred to a paper sheet, and multi-layered on the paper sheet, to obtain a color image. An image forming apparatus of this tandem type has an intermediate transfer belt unit.

Jpn. Pat. Appln. Laid-Open Publication No. 11-237794 describes an example of an image forming apparatus having an intermediate transfer belt unit. In this example, the image forming apparatus has, along with an intermediate transfer belt, a charge removal means for removing electric charges remaining on the intermediate transfer belt. In the charge removal means of this example, a high-resistance material is provided between the transfer belt and a predetermined low-potential part.

Another Jpn. Pat. Appln. Laid-Open Publication No. 2002-72615 also describes an example of an image forming apparatus having an intermediate transfer belt unit. In this example, an electrically charged potential on an intermediate transfer belt is detected after transfer, to control a transfer bias voltage of a toner image.

Still another Jpn. Pat. Appln. Laid-Open Publication No. 2005-308784 describes an example of an image forming apparatus having an intermediate transfer belt unit and a charge removal means for removing electric charges on the intermediate transfer belt. The charge removal means of this example has a bias application means for removing an electrically charged potential from the intermediate transfer belt.

Meanwhile, a primary transfer roller is located Facing a photosensitive drum. In order to extend lifecycle of the primary transfer roller, the primary transfer roller is desirably located apart from the photosensitive drum (for example, at color image forming sections during monochrome printing) except for necessary parts.

However, known image forming apparatuses cannot satisfactorily achieve both of improved structural performance of the separation mechanism and guaranteed performance of removing electric charges. Further improvement is demanded.

The present invention provides an image forming apparatus of a tandem type, which is capable of preventing scattering of toner by a charge removal mechanism and extending lifecycle of components.

DETAILED DESCRIPTION OF THE INVENTION

Throughout this description, the embodiments and examples shown should be considered as exemplars, rather than limitations on the apparatus of the present invention.

An embodiment of the invention will now be described in detail with reference to the drawings.

Figure 1:
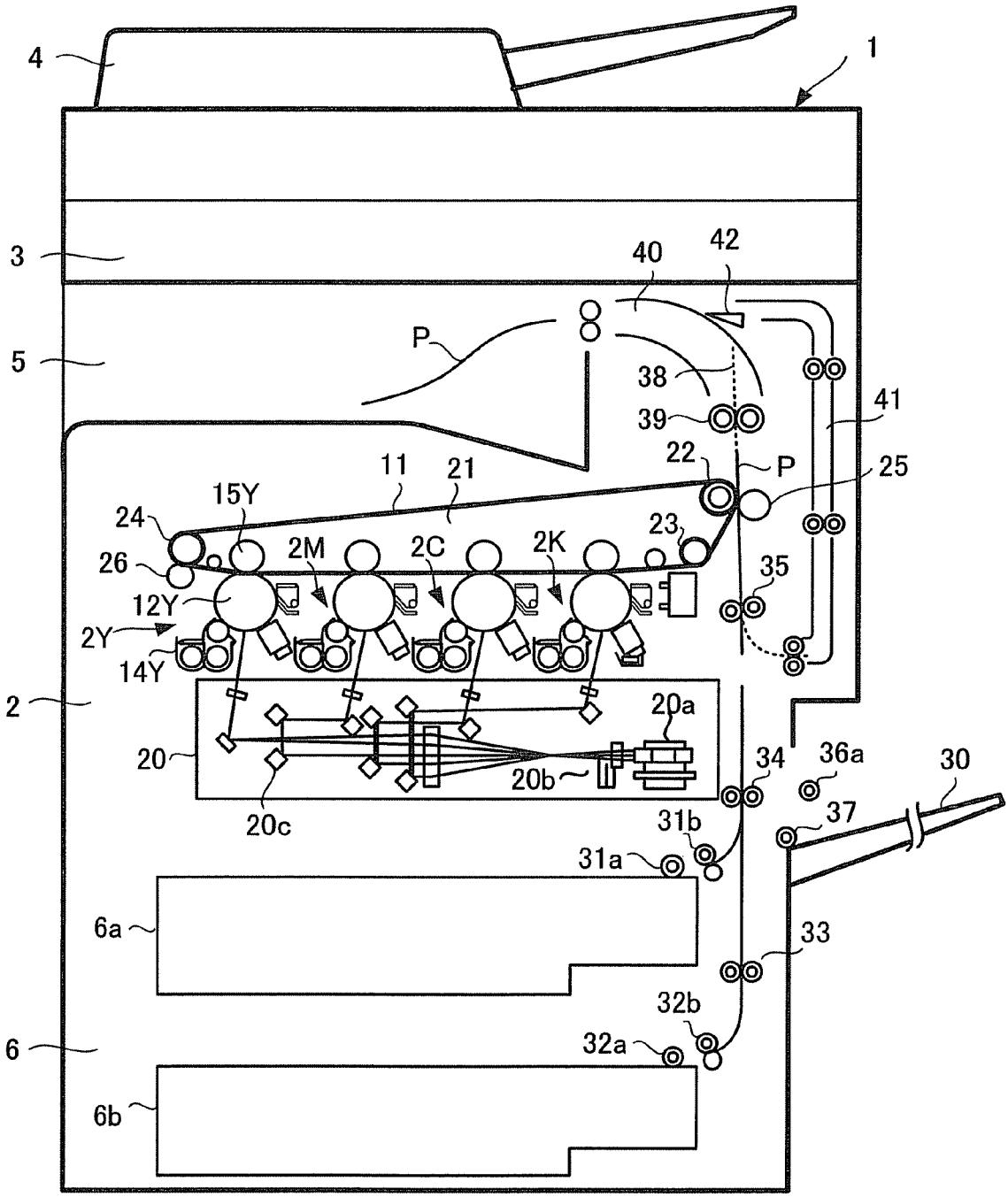
FIG. 1 shows an overall structure of an image forming apparatus according to an embodiment of the present invention.
Figure 2:
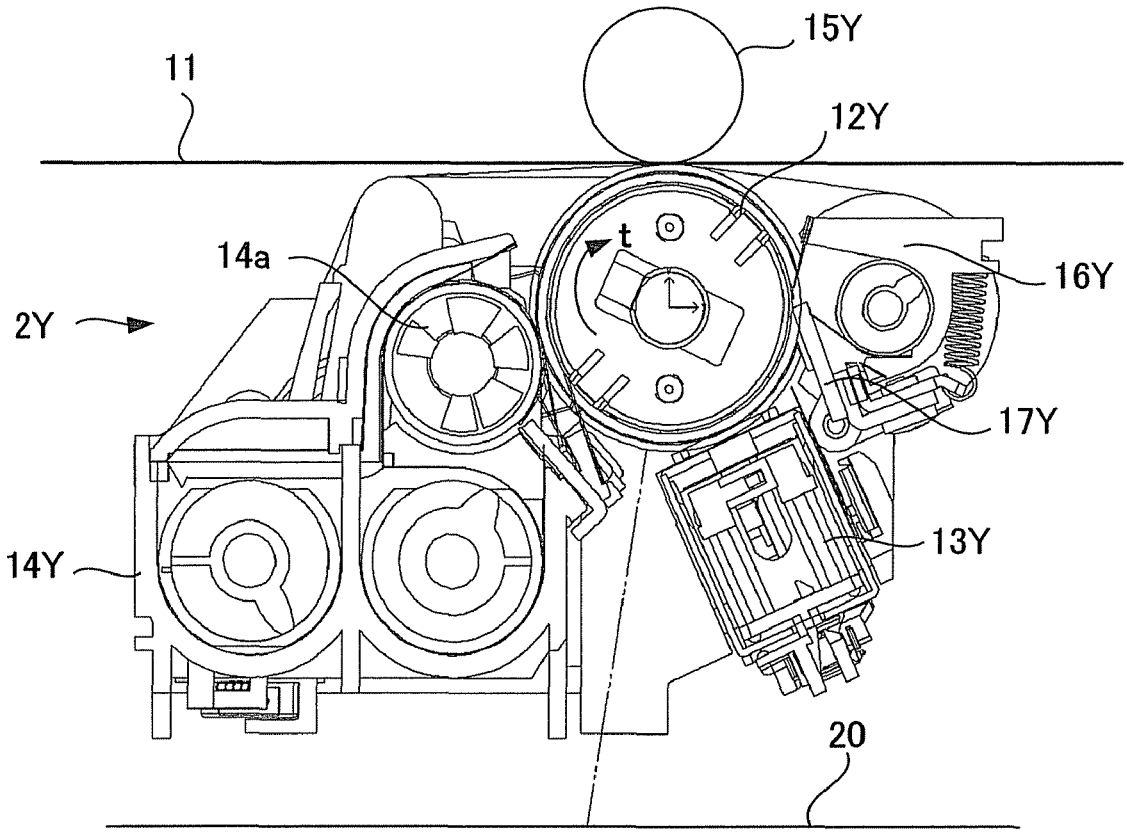
FIG. 2 is an enlarged side view showing a part of an image forming section of the image forming apparatus according to the invention.

FIG. 1 shows an internal structure of an image forming apparatus according to an embodiment of the invention. FIG. 2 is an enlarged side view of a part of FIG. 1. The following description will be made with reference to an example of a MFP (Multi-Functional Peripheral) as a composite apparatus. The invention is applicable to other image forming apparatuses such as printers, etc.

In FIG. 1, an image forming apparatus 1 has an image forming section 2 located in a middle part of the apparatus. An image reader section 3, an automatic document feeder (ADF) 4, and a sheet output section 5 are provided in upper parts of the image forming apparatus 1. The image forming apparatus 1 has an operation section and a display section in an upper part of the image forming apparatus 1 although the operation and display sections are omitted from the drawings. At a lower part of the image forming apparatus 1, a sheet feeder section 6 is provided.

The automatic document feeder 4 feeds a document to the image reader section 3, which reads the document and generates image data.

The image forming section 2 is constituted by, for example, a tandem type color laser printer, and scans a photosensitive member with a laser beam from a laser exposure device 20, to form an image.

The image forming section 2 includes image forming sections 2Y, 2M, 2C, and 2K for colors of yellow (Y), magenta (m), cyan (c), and black (K), respectively. The image forming sections 2Y, 2M, 2C, and 2K are arranged in parallel from the upstream side to the downstream side, below an intermediate transfer belt 11 as an intermediate transfer medium.

In the following description, components forming the image forming sections 2Y, 2M, 2C, and 2K will be denoted at reference numerals added with Y, M, C and K, respectively.

In some cases, the components will be described omitting the reference numerals Y, M, C and K.

Since the image forming sections 2Y, 2M, 2C and 2K have the same structure, only the image forming section 2Y will be described below as a representative examples of the image forming sections. The image forming section 2Y has a photosensitive drum 12Y. An electric charger 13Y, a developing device 14Y, a transfer roller 15Y, a cleaner 16Y, a blade 17Y, and the like are located around the photosensitive drum 12Y. Details of the structure of the image forming section 2Y is shown enlarged in FIG. 2.

The intermediate transfer belt 11 circularly moves, and semiconductive polyimide is used for the belt in view of heat resistance and abrasion resistance. The intermediate transfer belt 11 is suspended over a driving roller 22 and driven rollers 23 and 24. The intermediate transfer belt 11 can have contact with photosensitive drums 12Y to 12K. To a position of the intermediate transfer belt 11 where the belt faces the photosensitive drum 12Y, a primary transfer voltage of +1,000 V or so is applied from a primary transfer roller 15Y so that a toner image on the photosensitive drum 12Y is primarily transferred to the intermediate transfer belt 11.

A secondary transfer roller 25 is located so as to face the driving roller 22 suspending the intermediate transfer belt 11. When a paper sheet P passes between the driving roller 22 and the secondary transfer roller 25, a secondary transfer voltage of +1,000 V or so is applied from the secondary transfer roller 25, so that toner images on the intermediate transfer belt 11 are secondarily transferred to the paper sheet P. A belt cleaner 26 is provided near the driven roller 24 for the intermediate transfer belt 11.

FIG. 2 shows enlarged one of the image forming sections 2Y, 2M, 2C, and 2K. Referring to the image forming section 2Y as an example, an electric charger 13Y, a developing device 14Y, a primary transfer roller 15Y, a cleaner 16Y, a blade 17Y, and the like are provided around the photosensitive drum 12Y. To an exposure position of the photosensitive drum 12Y, a yellow laser beam is emitted from a laser exposure device 20, to form a latent image on the photosensitive drum 12Y.

In each of the image forming sections 2Y to 2K, the electric charger 13Y electrically charges uniformly the whole surface of the photosensitive drum 12 to, for example, −700 V or so. The developing device 14 supplies the photosensitive drum 12 with a two-component developer by a developing roller 14*a* which is applied with a developing bias of −500 V or so. The two-component developer contains toner of one corresponding color and a carrier. The cleaner 16 removes residual toner on the surface of the photosensitive drum 12 by use of the blade 17.

Meanwhile, the laser exposure device 20 scans the photosensitive drum 12 in an axial direction of the drum with a laser beam emitted from a semiconductor laser element. The laser exposure device 20 includes a polygon mirror 20*a*, an imaging lens system 20*b*, a mirror 20*c*, and the like.

The sheet feeder section 6 has plural sheet feeder cassettes 6*a* and 6*b* to contain paper sheets of various sizes. The image forming apparatus 1 further has a manual feed tray 30 for manually feeding paper sheets.

Between the sheet feeder cassettes 6*a* and 6*b* and the secondary transfer roller 25, there are provided pickup rollers 31*a* and 32*a*, separation rollers 31*b* and 32*b*, conveyor rollers 33 and 34, and a resist roller 35. The pickup rollers 31*a* and 32*b* pick out paper sheets from inside the sheet feeder cassettes 6*a* and 6*b*. Between the manual feed tray 30 and the resist roller 35, there are provided a pickup roller 36*a* for picking up paper sheets P, and a manual sheet feed roller 37.

Further, a fixing device 39 is provided in the downstream side of the secondary transfer roller 25 along a vertical path 38 for vertically conveying paper sheets P fed from the sheet feeder cassettes 6*a* and 6*b* or the manual feed tray 30.

Between the fixing device 39 and the sheet output section 5, there are provided a sheet output conveyor path 40 and a reverse conveyor path 41. A gate 42 is provided on the reverse conveyor path 41 to distribute paper sheets P to the sheet output section 5 or to the reverse conveyor path 41. The reverse conveyor path 41 reverses and guides paper sheets P in a direction toward the secondary transfer roller 25. The reverse conveyor path 41 is used when carrying out double-sided printing.

Operation of the image forming apparatus shown in FIGS. 1 and 2 will be described next. As image forming is started, image information is inputted from a scanner, personal computer terminal, or the like. Then, photosensitive drums 12 rotate and the image forming sections 2Y to 2K sequentially form images.

Referring to the image forming section 2Y as an example, the photosensitive drum 12Y is irradiated with a laser beam in accordance with image information for yellow (Y), thereby forming an electrostatic latent image. From the electrostatic latent image, a toner image for yellow (Y) is formed by the developing device 14Y. Subsequently, the photosensitive drum 12Y makes contact with the intermediate transfer belt 11 being rotated, thereby primarily transferring the toner image for yellow (Y) to the intermediate transfer belt 11 by the primary transfer roller 15Y.

In a similar manner to the toner image forming process for yellow (Y), toner images for magenta (M), cyan (C), and black (K) are formed by the image forming section 2M, 2C, and 2K, and are sequentially transferred to the same position on the intermediate transfer belt 11 as the toner image for yellow (Y) has been formed. Thus, toner images for yellow (Y), magenta (M), cyan (C), and black (K) are transferred to the intermediate transfer belt 11, multi-layered on one another, so that a full color toner image is obtained.

Further, the intermediate transfer belt 11 secondarily transfers the full color toner image all at once to a paper sheet P by a transfer bias of the secondary transfer roller 25. The paper sheet P is fed to the position of the secondary transfer roller 25 from the sheet feeder cassettes 6*a* or 6*b* or the manual feed tray 30, synchronized with timing when the full color toner image on the intermediate transfer belt 11 reaches the secondary transfer roller 25. The paper sheet P to which the toner image has been secondarily transferred reaches a fixing roller 39, and the toner image is fixed.

In case of printing an image only on one side (single-sided printing), the paper sheet P is distributed to the sheet output section 5 by the gate 42. Otherwise, in case of double-sided printing or multi-layered printing, the paper sheet P is distributed to the reverse conveyor path 41 and conveyed again to the secondary transfer roller 25.

After completion of the secondary transfer, residual toner is cleaned from the intermediate transfer belt 11 by the belt cleaner 26. From each photosensitive drum 12, residual toner is cleaned by the cleaner 16 and blade 17 after primary transfer of a toner image to the intermediate transfer belt 11, to become ready for next image forming.

The blade 17 is in contact with the photosensitive drum 12. As the photosensitive drum 12 rotates, the blade 17 finely scrapes away a coating on the photosensitive drum 12 and an edge of the blade 17 itself is abraded. The process as described above is repeated so that an amount of abrasion of the photosensitive drum 12 or blade 17 exceeds a certain amount, and desired performance cannot be achieved. In other words, lifecycle of the photosensitive drum 12 or blade 17 depends on total operation period.

Therefore, in order to extend lifecycle, the photosensitive drum 12 and the primary transfer roller 15 are located apart from each other (for example, at color image forming sections during monochrome printing) except for necessary parts.

Figure 3:
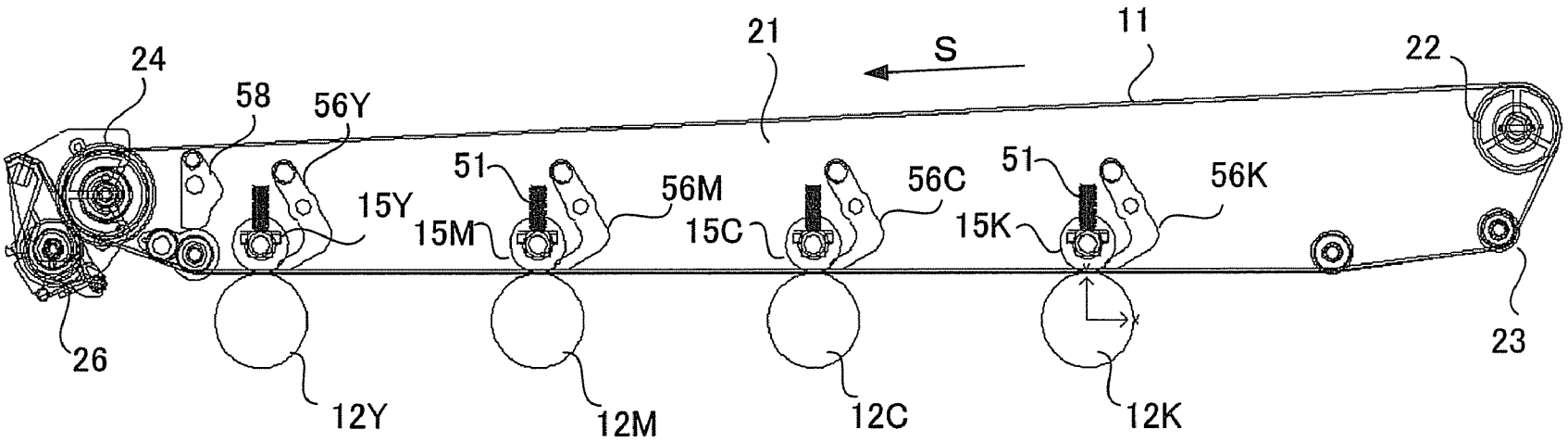
FIG. 3 is a side view showing a structure of a transfer unit including a separation mechanism, in the image forming apparatus according to the invention.

FIG. 3 schematically illustrates a structure of a transfer unit 21 including a transfer belt 11, including a separation mechanism which will be described later. The transfer belt 11 is driven by a driving roller 22 to travel in the direction of an arrow S. A bias is applied to primary transfer rollers 15Y to 15K located at positions where the rollers face the photosensitive drums 12Y to 12K. Toner images developed on the photosensitive drums 12Y to 12K are transferred to the transfer belt 11. At this time, each of the primary transfer rollers 15 is pressed against the photosensitive drum 12 so as to form a constant nip by dead weight of the roller and pressure from a spring 43.

The same process as described above is carried out to form a toner image by each of the image forming sections 2Y to 2K for respective colors. Toner images for respective colors are layered on one another to form a color image. After forming the image, residual toner on the transfer belt 11 is cleaned by the belt cleaner 26.

When no color image is formed, e. g., when monochrome text information is formed, toner consumption can be reduced by developing only a latent image for black (K). In this case, the other color image forming sections 2Y, 2M, and 2C than the image forming section 2K should desirably not operated because lifecycle of each image forming section 2 depends on a total operation period.

If the transfer belt 11 is rotated in contact with the photosensitive drums 12 under pressure applied by primary transfer, the photosensitive drums 12 and the transfer belt 11 are abraded or damaged. Therefore, a mechanism for moving the transfer belt 11 apart from the photosensitive drums 12 is required. Toner remaining on the transfer belt 11 needs to be cleaned after forming an image. In this case, if the transfer belt 11 is cleaned while rotating the photosensitive drums 12, the photosensitive drums 12 rotate wastefully long because the transfer belt 11 is much longer than the peripheral length of each photosensitive drum 12. As a result, lifecycle of photosensitive drums 12 and peripheral components is shortened. This shortening of lifecycle can be overcome by separating the transfer belt 11 apart from the photosensitive drums 12 to allow only the transfer belt 11 to travel or by allowing the transfer belt 11 to travel independently.

Figure 4:
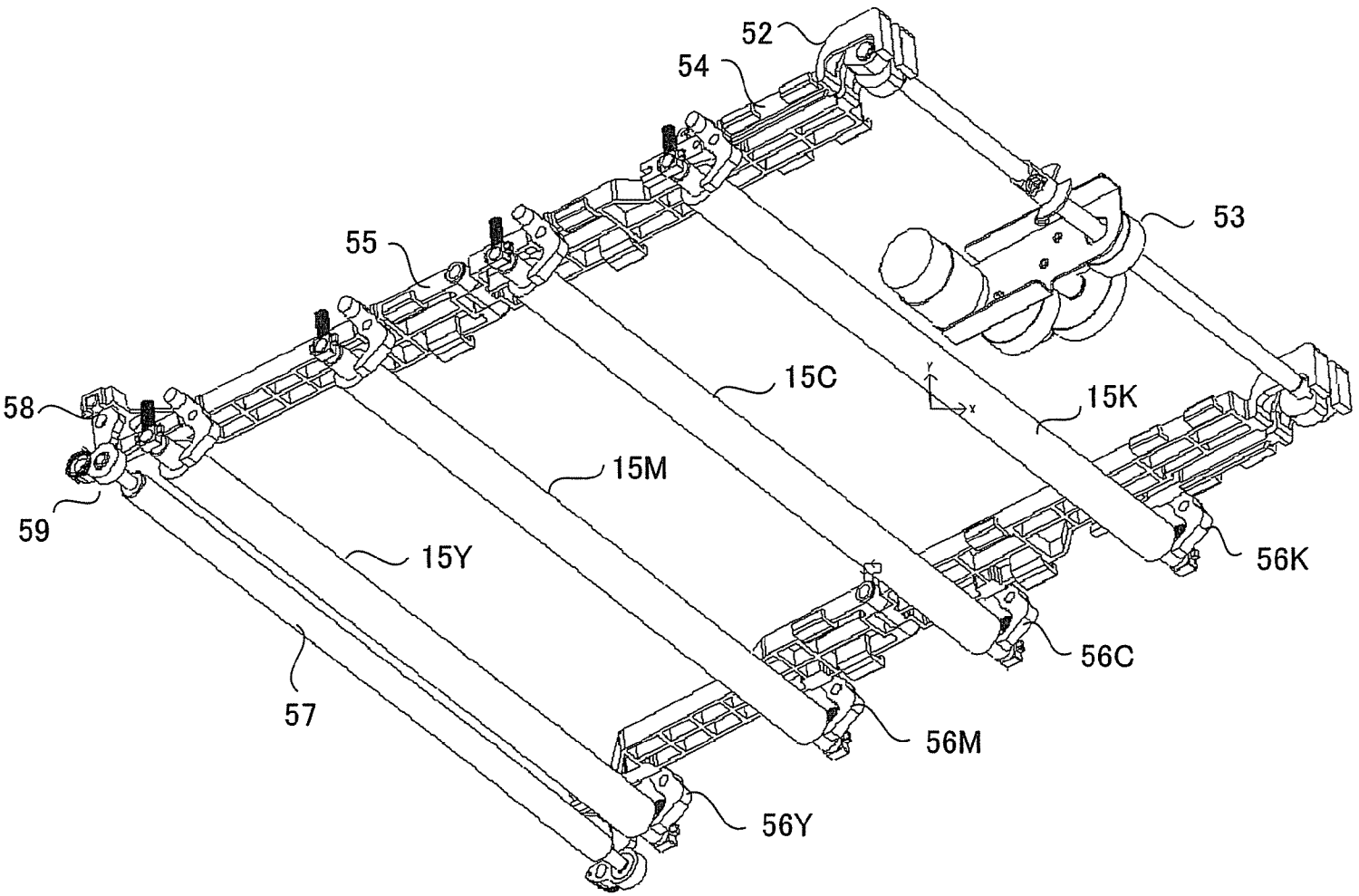
FIG. 4 is a perspective view showing the separation mechanism of in the image forming apparatus according to the invention.

FIG. 4 shows a schematic structure of a separation mechanism for separating the transfer belt 11 apart from the photosensitive drums 12. FIG. 4 is a perspective view of the separation mechanism observed from the bottom side. The separation mechanism is constituted by cams 52, a drive system 53 for driving the cams 52, links 54 and 55, lifters 56Y to 56K, a belt tension roller 57, roller cams 58, and roller holders 59.

The links 54 serve to drive the primary transfer roller 15K for black (K), and the links 55 serve to drive the primary transfer rollers 15*y* to 15C for color. The links 54 move lifters 56K. The links 55 move lifters 56Y to 56C. The roller holders 59 are applied with an upward load by springs.

The drive system 53 drives the cams 52 so that the lifters 56Y to 56K are rotated via the links 54 and 55. Hooks at top ends of the lifters 56Y to 56K lift up the primary transfer rollers 15Y to 15K. At the same time, the roller cams 58 rotate and the roller holders 59 are lifted up by springs, thereby separating the transfer belt 11 apart from the photosensitive drums 12Y to 12K.

At this time, the links 54 and 55 are operated individually switched depending on positions of the cams 52. Accordingly, a full-color mode of using all colors, a monochrome mode of using only one color of black, and a complete separation mode of separating all transfer rollers apart from the belt can be switched to each other.

Figure 5A:
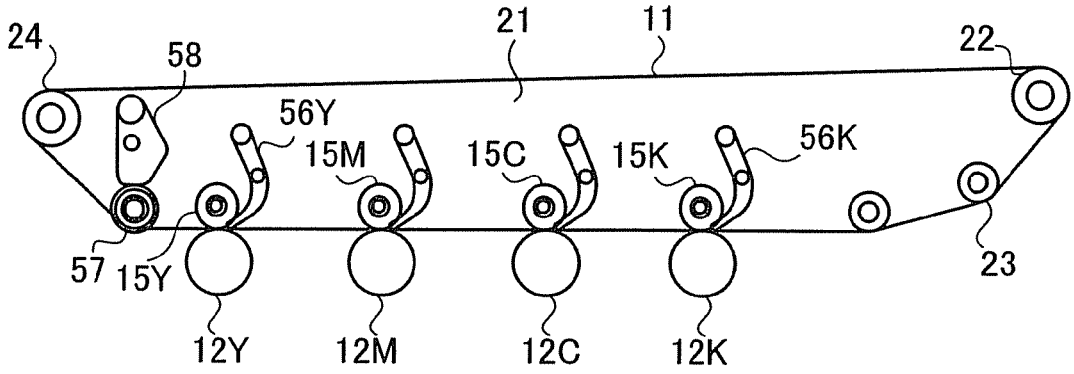
FIG. 5A, FIG. 5B, and FIG. 5C are views depicting operation of the separation mechanism in the image forming apparatus according to the invention.

FIG. 5A shows a state in the full color mode in which the primary transfer rollers 15Y to 15K are in contact with the photosensitive drums 12Y to 12K.

Figure 5B:
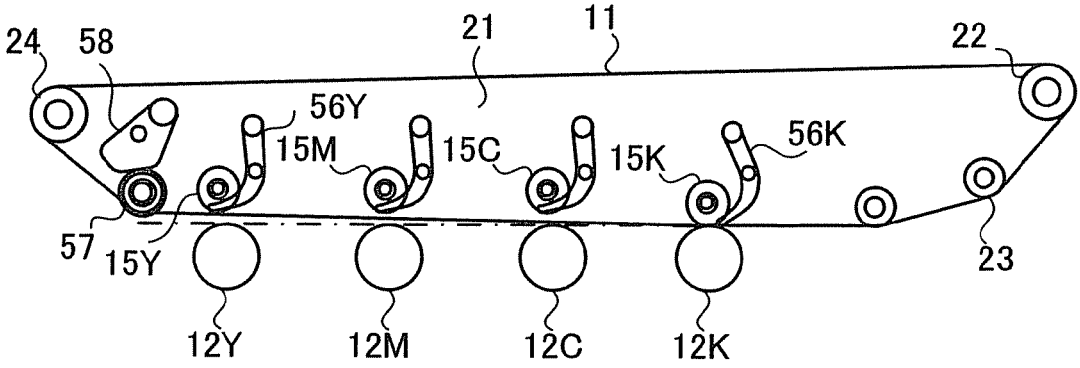

FIG. 5B shows a state in the monochrome mode in which only the primary transfer roller 15K is in contact with the photosensitive drum 12K. The other color primary transfer rollers 15Y to 15C are respectively apart from the photosensitive drums 12Y to 12C.

Figure 5C:
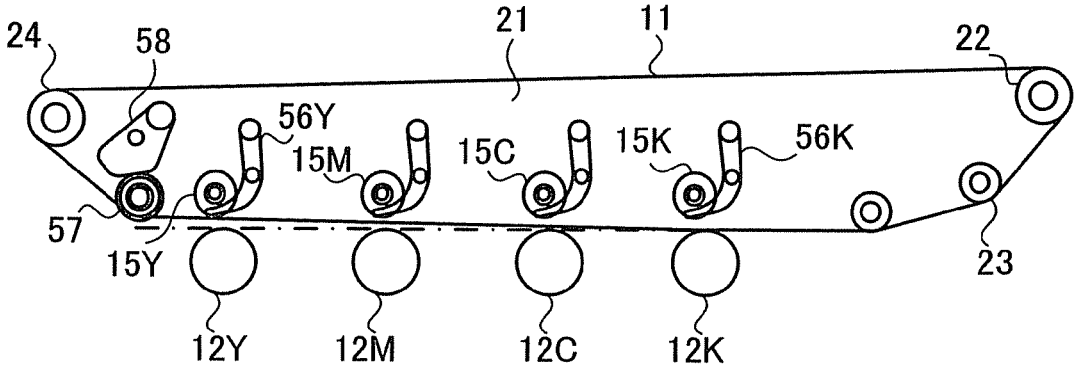

FIG. 5C shows a state in the complete separation mode in which all the primary transfer rollers 15Y to 15K are respectively apart from the photosensitive drums 12Y to 12K.

Figure 6:
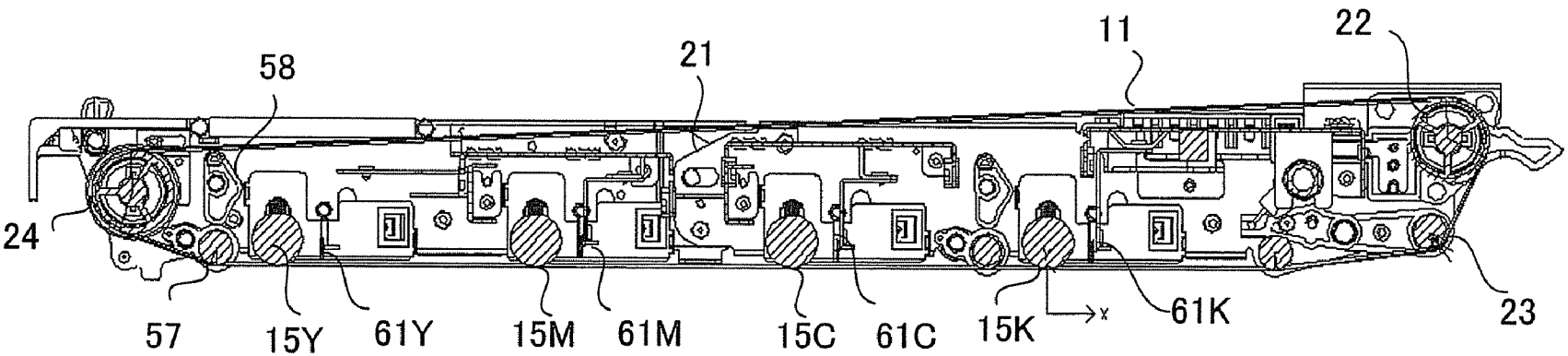
FIG. 6 is a side view showing a structure of the transfer unit including a charge removal mechanism, in the image forming apparatus according to the invention.

FIG. 6 shows a charge removal mechanism according to the embodiment of the invention. The transfer rollers 15M to 15K of the transfer unit 21 are respectively provided with grounded charge removal brushes 61M to 61K which are located with a predetermined clearance maintained to the transfer belt 11.

The charge removal brushes 61Y to 61K are respectively located at positions in the downstream side of the transfer belt 11, near the transfer rollers 15Y to 15K. The clearance between the charge removal brushes 61Y to 61K and the transfer belt 11 decreases toward the downstream side.

Figure 7:
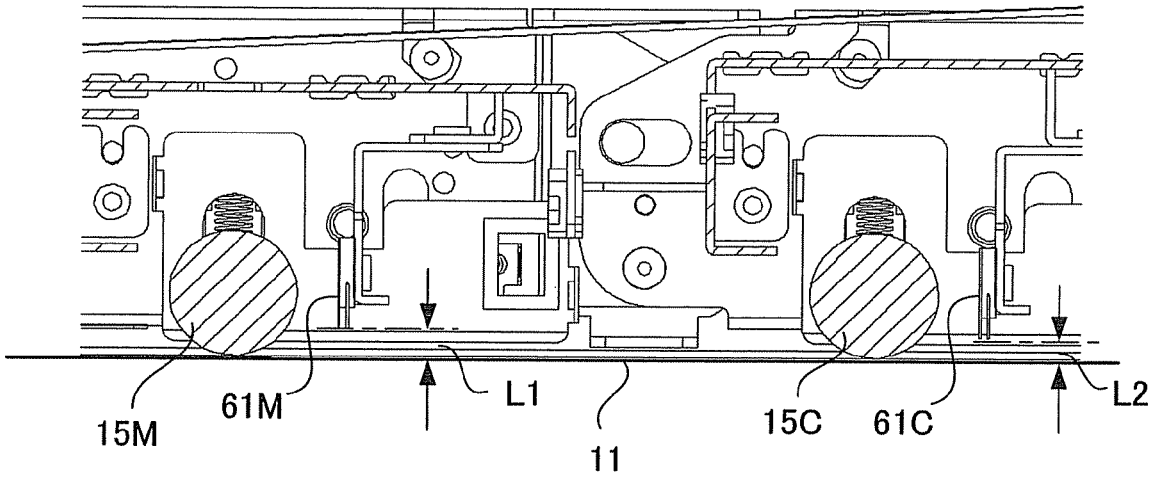
FIG. 7 is an enlarged view depicting a part of the transfer unit in the image forming apparatus according to the invention.

FIG. 7 shows an enlarged part of the charge removal mechanism, e.g., charge removal brushes 61M and 61C. Where a clearance between the charge removal brush 61M and the transfer belt 11 is L1 as well as a clearance between the charge removal brush 61C and the transfer belt 11 is L2, the clearances are set to satisfy L1>L2 so that the clearances between the charge removal brushes and the transfer belt are narrowed gradually toward the downstream side.

The more downstream side the charge removal brushes 61Y, 61M, 61C, and 61K are located in, the narrower the clearance between the charge removal brushes and the transfer belt is. However, the charge removal brushes 61Y to 61K do not make contact with the transfer belt 11 while forming an image. Accordingly, the charge removal brushes 61Y, 61M, 61C, and 61K are prevented from being worn or falling off.

Figure 8:
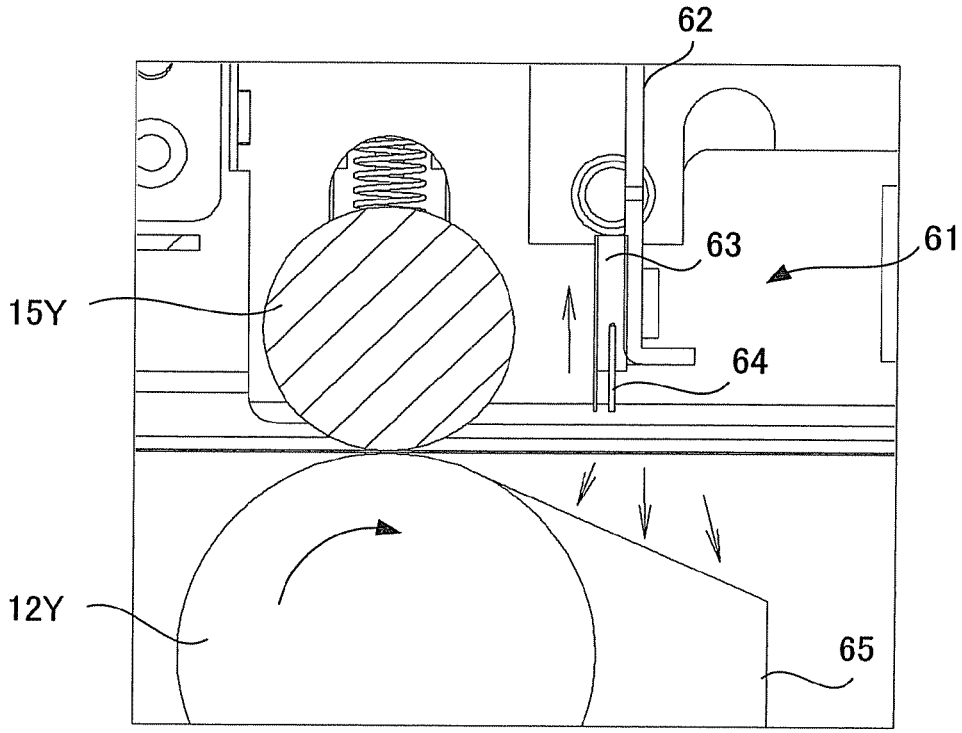
FIG. 8 is an enlarged view depicting the charge removal mechanism in the image forming apparatus according to the invention.

FIG. 8 shows a detailed structure of the charge removal brush 61. An aluminum holder 63 is attached to a frame 62, and a brush 64 is fixed to an end part of the aluminum holder 63 which faces the transfer belt 11. After electric charges are removed from the transfer belt 11 by the charge removal brush 61, the potential on the transfer belt 11 becomes stable. As a result, potential differences are stabilized between the transfer belt 11 and surfaces of unit frames 65 to which the photosensitive drums 12 are attached. Accordingly, toner is hindered from moving to the frames 65, and therefore, toner forming an image is prevented from scattering.

In the most upstream side, the transfer belt 11 is charged only by the image forming section 2Y. Toward the downstream side, the transfer belt 11 is electrically charged by a gradually increasing number of image forming sections 2M, 2C, and 2K, and the amount of electric charges increases accordingly. Therefore, in the most upstream side, the charge removal brush 61 is most distant from the transfer belt 11. The charge removal brushes 61 are located gradually closer to the transfer belt 11 toward the downstream side. In this manner, electric charges can be securely removed.

The color image forming sections 2Y, 2M, and 2C are located in the upstream side while the black (K) image forming section 2K is located in the most downstream side. This layout is capable of shortening the clearance to the secondary transfer roller 22 in the monochrome mode, so that time between forming a toner image and transferring the image can be shortened. That is, efficiency of image forming processing can be improved in the monochrome mode which is most frequently used.

Although an example of using charge removal brushes 61 as charge removal members has been described, metal plates or the like can be used in place of the charge removal brushes 61. The structure of each charge removal member can be modified to have a different form.

According to the invention as has been described above, a separation mechanism allows a transfer belt and photosensitive drums to make contact with each other only at necessary parts in an image forming apparatus of a tandem type. As a result, lifecycle of each photosensitive drum can be extended.

In addition, a charge removal mechanism is capable of preventing toner from scattering. Furthermore, a satisfactory charge removal effect can be satisfactorily ensured by the charge removal mechanism even in case of employing such a charge removal mechanism. Accordingly, lifecycle of components can be extended longer.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus comprising:

a plurality of image forming sections that includes a first image forming section and a second image forming section, the plurality of image forming sections each having at least a photosensitive drum;

a transfer belt that moves toward the plurality of first image forming sections;

a plurality of transfer rollers that respectively face the photosensitive drums of the plurality of image forming sections with the transfer belt interposed between the transfer rollers and the photosensitive drums;

a plurality of charge removal members that are respectively provided adjacent to the transfer rollers, and remove electric charges charged on the transfer belt, with a clearance maintained between the transfer belt and the charge removal members; and a changer that changes positions of the transfer rollers between a first position where only the transfer roller for the second image forming section comes into contact with the corresponding photosensitive drum and the transfer roller for the first image forming section is separated from the corresponding photosensitive drum, and a second position where all the transfer rollers for the first image forming section and the second image forming section come into contact with the corresponding photosensitive drums, wherein the charge removal member for the second image forming section among the plurality of the charge removal members approaches the transfer belt most closely at the second position, and all the plurality of charge removal members for the first image forming section and the second image forming section maintain clearance with the transfer belt at the first position and at the second position.

2. An image forming apparatus according to claim 1, wherein the plurality of charge removal members are constituted by charge removal brushes.

3. An image forming apparatus according to claim 1, wherein the first image forming section has a plurality of color image forming sections, and the second image forming section is a monochrome image forming section being located in a most downstream side along a moving direction of the transfer belt.

4. An image forming apparatus according to claim 3, wherein the charge removal member is provided to each of the plurality of color image forming sections and the monochrome image forming section, and the clearance between the transfer belt and each of the charge removal members is narrowed from an upstream side toward a downstream side along the moving direction of the transfer belt.

5. An image forming apparatus, comprising:

a plurality of image forming sections that includes a first image forming section and a second image forming section, the plurality of image forming sections each having at least a photosensitive drum;

an intermediate transfer medium that moves toward the plurality of image forming sections;

a plurality of transfer rollers that respectively face the photosensitive drums of the plurality of image forming sections with the intermediate transfer medium interposed between the transfer rollers and the photosensitive drums;

a plurality of charge removal members that are respectively provided adjacent to the transfer rollers with a clearance maintained between the intermediate transfer medium and the charge removal members, and remove electric charges charged on the intermediate transfer medium; and a changer that changes positions of the transfer rollers between a first position where only the transfer roller for the second image forming section comes into contact with the corresponding photosensitive drum and the transfer roller for the first image forming section is separated from the corresponding photosensitive drum, and a second position where all the transfer rollers for the first image forming section and the second image forming section come into contact with the corresponding photosensitive drums, wherein the charge removal members of the second image forming section among the plurality of the charge removal members approach the intermediate transfer medium most closely at the second position, and all the plurality of charge removal members for the first image forming section and the second image forming section maintain clearance with the intermediate transfer medium at the first position and at the second position.

6. An image forming apparatus according to claim 5, wherein the intermediate transfer medium is suspended between a driving roller and a driven roller, has a secondary transfer roller that is disposed in a manner facing the driving roller, and carries out secondary transfer by inserting a sheet between the driving roller and the secondary transfer roller.

7. An image forming apparatus comprising:

a plurality of image forming means for including a first image forming section and a second image forming section each having at least a photosensitive drum, and forming a toner image on each of the photosensitive drums;

transfer means for including a transfer belt that moves toward the plurality of image forming sections and a plurality of transfer rollers that respectively face the photosensitive drums with the transfer belt interposed between the transfer rollers and the photosensitive drums, and transferring the toner image to the transfer belt;

charge removing means for including a plurality of charge removal members provided in the vicinity of the transfer rollers with a clearance maintained between the transfer belt and the charge removal members, and removing electric charges charged on the transfer belt; and changing means for changing positions of the transfer rollers between a first position where only the transfer roller for the second image forming section comes into contact with the corresponding photosensitive drum and the transfer roller for the first image forming section is separated from the corresponding photosensitive drums, and a second position where all the transfer rollers for the first image forming section and the second image forming section come into contact with the corresponding photosensitive drum, wherein the charge removal means for the second image forming section among the plurality of the charge removal members approach the transfer belt most closely at the second position, and all the plurality of charge removal members for the first image forming section and the second image forming section maintain clearance with the transfer belt at the first position and at the second position.

8. An image forming apparatus according to claim 7, wherein the first image forming section has a plurality of color image forming sections, and the second image forming section is a monochrome image forming section being located in a most downstream side along a moving direction of the transfer belt.

9. An image forming apparatus according to claim 8, wherein the charge removing means provides the charge removal member to each of the plurality of color image forming sections and the monochrome image forming section, and the clearance between the transfer belt and each of the charge removal members is narrowed from an upstream side toward a downstream side along the moving direction of the transfer belt.

10. An image forming apparatus comprising:

a plurality of image forming sections that includes a first image forming section and a second image forming section, the plurality of image forming sections each having at least a photosensitive drum;

a transfer belt that moves toward the plurality of image forming sections;

a plurality of transfer rollers that respectively face the photosensitive drums of the plurality of image forming sections with the transfer belt interposed between the transfer rollers and the photosensitive drums;

a plurality of charge removal members that are respectively provided adjacent to the transfer rollers, and remove electric charges charged on the transfer belt, with a clearance maintained between the transfer belt and the charge removal members; and a changer that changes positions of the transfer rollers between a first position where only the transfer roller for the second image forming section comes into contact with the corresponding photosensitive drum and the transfer roller for the first image forming section is separated from the corresponding photosensitive drum, and a second position where all the transfer rollers for the first image forming section and the second image forming section come into contact with the corresponding photosensitive drums, wherein the charge removal member for the second image forming section among the plurality of the charge removal members approaches the transfer belt most closely at the second position.

* * * * *